US007789202B2

(12) United States Patent
Lee et al.

(10) Patent No.: US 7,789,202 B2
(45) Date of Patent: Sep. 7, 2010

(54) ORIENTATION AND GRAVITY INSENSITIVE IN-CASING OIL MANAGEMENT SYSTEM FOR FLUID DISPLACEMENT DEVICES, AND METHODS RELATED THERETO

(75) Inventors: Kang P. Lee, Sudbury, MA (US); William Gronemeyer, Wilmington, MA (US)

(73) Assignee: Aspen Compressor, LLC., Marlborough, MA (US)

( * ) Notice: Subject to any disclaimer, the term of this patent is extended or adjusted under 35 U.S.C. 154(b) by 154 days.

(21) Appl. No.: 11/861,797

(22) Filed: Sep. 26, 2007

(65) Prior Publication Data

US 2008/0078618 A1 Apr. 3, 2008

Related U.S. Application Data

(60) Provisional application No. 60/827,681, filed on Sep. 29, 2006.

(51) Int. Cl.
*F01M 11/03* (2006.01)
*F04B 49/00* (2006.01)

(52) U.S. Cl. ..... 184/6.2; 184/6; 184/6.16; 184/27.1; 184/31; 417/110; 417/203; 417/310; 417/312; 417/313; 417/415; 417/902; 418/15; 418/55.5; 418/55.6; 418/63; 418/88; 418/100; 418/150

(58) Field of Classification Search ..... 184/6.2, 184/6.16–6.18; 62/84; 417/68, 410.3; 418/63, 418/94, 151
See application file for complete search history.

(56) References Cited

U.S. PATENT DOCUMENTS 4,091,638 A * 5/1978 Mitch ..... 62/470
4,957,517 A 9/1990 Linnert
4,971,529 A * 11/1990 Gannaway et al. ..... 417/313
5,060,759 A 10/1991 Dussourd et al.
5,087,170 A * 2/1992 Kousokabe et al. ..... 415/110
5,336,060 A * 8/1994 Tomell et al. ..... 417/410.5
5,431,547 A * 7/1995 Boyko ..... 417/366

(Continued)

OTHER PUBLICATIONS

PCT/US 07/79545, Apr. 24, 2008, ISA/US, International Search Report.

*Primary Examiner*—Robert A Siconolfi
*Assistant Examiner*—San Aung
(74) *Attorney, Agent, or Firm*—IP Law Services, LLC.; Lucy Elandjian

(57) ABSTRACT

Disclosed is a pressurized internal oil management system, comprising an oil dam, at least one oil separator, at least one oil collection manifold, at least one oil pump, and one or more paths for returning the separated oil; said system integrated within the casing of a fluid displacement device to supply adequate lubrication regardless of orientations under zero to full gravity, and methods and applications related thereto. Fluid displacement devices useful herein include oil lubricated rotary or reciprocating machinery, such as compressors, expanders, pumps and engines, in the casing of which exists one or more drive mechanisms that can be utilized to operate the oil management system, in most cases without even increasing the size of the casing. The present invention is especially useful for applications where small size and low weight of the fluid displacement device or the system containing it are important, such as personal or electronic cooling systems in terrestrial mobile applications or various cooling systems in aerospace applications.

24 Claims, 9 Drawing Sheets

U.S. PATENT DOCUMENTS 6,213,732 B1 * 4/2001 Fujio ..... 417/312
6,682,323 B2 * 1/2004 Milliff et al. ..... 417/410.5
2004/0191082 A1 * 9/2004 Gennami et al. ..... 417/310
2004/0191083 A1 9/2004 Gennami et al.

* cited by examiner (Prior Art)

ORIENTATION AND GRAVITY INSENSITIVE IN-CASING OIL MANAGEMENT SYSTEM FOR FLUID DISPLACEMENT DEVICES, AND METHODS RELATED THERETO

CROSS REFERENCE TO RELATED APPLICATION

This is a non-provisional application claiming the benefit of and priority to provisional patent application having Ser. No. 60/827,681 and filed on Sep. 29, 2006, which is incorporated herein by reference.

TECHNICAL FIELD

The present invention relates generally to an internal oil management system, and methods related thereto. Specifically, the present invention pertains to an oil management system that can be integrated within the casing of fluid displacement devices to ensure an adequate supply of lubricating oil without regard to orientation or gravity.

BACKGROUND

The emergence of new small-scale vapor compression refrigeration systems has created an opportunity to create portable or wearable refrigeration systems, and often times these new applications require operating the compressor in non-vertical orientations and/or under various accelerations and gravity levels. One such application is in the thermal management of various electronic components, such as microprocessors, electronics, telecommunications, and guidance equipment on board terrestrial or aerospace vehicles. Another application is the man-portable cooling system for thermal protection of aviators, soldiers, emergency response teams, and hazardous materials handlers. Yet other applications include compressor based systems, such as cooling systems, for use in zero to low gravity environments in space. Some of these systems place special requirements on compressors not previously encountered in stationary refrigeration systems in that the oil lubrication that previously relied on gravity based oil sump is no longer usable due to lack of gravity or to orientation of the compressor being not in line with the gravity all of the time. In applications for which larger system sizes can be tolerated, such as fluid displacement devices, e.g., with over 20 cc of displacement per cycle, an external oil management system consisting of separation, collection and circulation functions can be used to enable operation of the compressor in any orientation. However, for most of the above-mentioned new applications, it is preferred or required that the compressor and refrigeration system be ultra-lightweight, highly compact (thus making an external oil management system undesirable) and perform reliably and efficiently in arbitrary orientations and under varying levels of gravity or accelerations.

Several types of compressors are currently available for use in refrigeration systems. For home refrigerators and air conditioners, rolling piston compressors, also referred to as fixed (or stationary) vane rotary compressors, are commonly used. In such a compressor, the vane does not rotate along with the rotor, but instead reciprocates in a slot enclosed by the stationary part of the compressor. The cylindrical part of the compressor that is mounted on the eccentric shaft is named a rolling piston because it appears to roll on the cylindrical surface of the cylinder wall. During the suction portion of a rolling piston compressor cycle, refrigerant gas is drawn through an inlet port into the rotary chamber, increasing the gas volume. Compression process takes place on the opposite side of the piston and vane, where the volume of gas decreases due to the eccentric motion of the roller. Discharge flow is controlled via a discharge valve.

While the small size (for a given capacity) of rolling piston compressors is advantageous, the leakage of refrigerant along the surfaces of the cylinder wall has to be maintained low enough to ensure high performance. Lubricating oil that is used in the compressor performs two functions essential to the proper functioning of the compressor's pump parts. The first function pertains to the lubrication of the moving parts themselves, in order to reduce frictional losses and prolong the life of the machine parts. The second function pertains to the sealing of all clearances between the moving parts and stationary parts, in order to minimize direct gas leakage that would adversely affect the capacity and efficiency of the compressor. Although the lubricating oil performs the above two essential functions inside of the compressor, once the oil leaves (along with the refrigerant) the compressor, the presence of oil in the refrigerant is not desirable as it is detrimental to the refrigeration system in many ways. For example, the oil coats the surfaces of the heat exchangers and thereby increasing the thermal resistance and lowering the heat exchanger effectiveness; it increases the pressure drop inside heat exchangers and thus draining energy and lowering the capacity and efficiency; it decreases the heat exchanger capacity; and etc. In short, the lubricating oil may be necessary and desirable inside of the compressor but utterly unnecessary and highly undesirable outside of the compressor in a refrigeration system. Further, if the oil leaving the compressor through the discharge tube can be minimized, the total amount of oil in the compressor and in the entire system can be reduced without detrimental effect. Lower volume of oil can result in the reduction of the volume of the compressor itself. Therefore, it is highly desirable to minimize the amount of oil entrained/mixed in the refrigerant going out of the compressor and traveling though the refrigeration system.

In the case of a household refrigerator or any other stationary or on-board refrigeration systems using a compressor, one is cautioned against storing, transporting or operating a refrigerator in any direction other than vertical or close to vertical within a narrow range. This near vertical orientation is necessary, otherwise the lubrication oil will either leak out of the oil sump located at the bottom of the compressor or not be sucked in to lubricate the machinery, and if the compressor is operated without the lubricating oil in proper places, the compressor will most likely become damaged prematurely or the motor can burn out due to increased friction. In the case of a portable cooling system worn by a person or transported in vehicles, airplanes, or in space, there is no easy way to ensure that the orientation of the compressor will be maintained close to vertical at all times unless the entire system is gimbaled, which in most cases is impractical. Consequently, in these above cases, the oil may not be in the oil sump or the oil in the sump will not be available for lubrication on start-up or during operation. Further, when the gravitation field is weak, such as in space, earth orbits or in systems undergoing accelerations that will alter the effective gravitational fields, the traditional sump arrangement at the bottom of the compressor casing will not function properly to provide necessary lubrication for the moving/rotating parts of the compressor. As described above, there are special lubrication and oil management requirements for compressors and other machinery used in portable applications in general and under rapidly changing accelerations or weak gravity.

SUMMARY OF THE INVENTION

Various configurations for rotary compressors for standard refrigerants exist at present. However, these compressors will not perform satisfactorily or can be damaged prematurely if the compressors are tilted beyond a small solid angle of the vertical axis in line with the gravitational field for more than a brief period of time, which is determined by the size of the sump and the speed of oil loss due to the tilting. In fact, if the refrigeration system has been stored in a non-vertical position, it is typically advised that the system be set upright for at least a half an hour prior to turning the system on. This precaution is mainly to return the oil that had leaked out of the sump, during the non-vertical storage or transportation, back in to the sump. For large systems, an external oil filter and management system may be used to alleviate the off-axis operation by creating a pressurized loop oil pumping system; however, for small systems, e.g., those having a displacement volume of less than 20 cc per cycle, such an external system may become untenable due to added volume and/or weight.

In view of the above, there is a need for orientation/gravity-insensitive, compact, ultralight, oil management systems for use with oil lubricated fluid displacement devices, such as rotary compressors that use standard refrigerants.

It is, therefore, an aspect of the present invention to provide a compact, ultralight, oil management system integrated into a fluid displacement device, such as a rotary compressor.

It is another aspect of the present invention to provide a compact, ultralight, oil management system that is inherently capable of operating in all orientations and under varying levels of gravity.

It is another aspect of the present invention to provide a method for operating an orientation and gravity insensitive oil management system integrated into a fluid displacement device.

The present invention pertains to an orientation and gravity insensitive oil management system for use with a fluid displacement device. Although the present invention can be utilized with any type of a fluid displacement device, it is preferably used with a compressor, and more preferably with an ultralight, miniature oil lubricated rolling piston compressor that comprises a compressor mechanism and a brushless DC motor. The oil lubricated rotary compressor is preferably housed in a hermetically or semi-hermetically sealed casing. The compressor mechanism comprises an omni-directional, gravity insensitive lubricant oil management system, a compression cylinder, a shaft having an eccentric part, top and bottom bearings to support the shaft, openings for communicating with lubricant oil, a roller, a vane, and inlet (also referred to as suction) and discharge tubes. The lubricating oil management system mechanism of the present invention may further comprise oil separator(s), reservoir, oil dam, pump(s) and flow paths.

In one embodiment of the present invention, an oil dam is provided in such a way as to create two general spaces within a compressor casing:) 1) the oil reservoir space—the area defined by the compressor casing and one side of the oil dam, wherein the compressor pump part is located, and wherein most of the entire refrigeration system's oil is stored at any given moment and from which oil is fed into the lubricated surfaces of the compressor; and, 2) the oil separator space—the area defined by the compressor casing and other side of the oil dam, wherein the oil separator(s), the oil pump, and the brushless DC motor are located and wherefrom the oil being separated from the refrigerant is pumped back to the oil reservoir space. The oil dam may comprise a check valve for controlling the flow of oil in one direction—from the oil separator space to the oil reservoir space. The oil reservoir space may comprise an optional oil reservoir access port through the compressor casing.

In one embodiment of the present invention, a centrifugal oil separator-pump is located immediately below the brushless DC motor of the compressor to separate most of the oil from the refrigerant, prior to discharging and pumping it back to the oil reservoir space, so as to permit adequate lubrication of the compressor regardless of the compressor's orientation with respect to the direction of gravity.

In one embodiment of the present invention, a centrifugal oil separator is located, e.g., embedded, inside of the rotor of the compressor's brushless DC motor to separate most of the oil from the refrigerant, prior to discharging and sending it back to the oil reservoir space, so as to permit adequate lubrication of the compressor regardless of the compressor's orientation with respect to the direction of gravity.

In one embodiment of the present invention, an oil pumping system utilizes the centrifugal force imparted to the separated oil. As the oil droplets land on the rotating disk, due to the rotational motion of a disk attached to the rotating shaft of the compressor, the lubricating oil is pushed into an oil reservoir within the oil dam from which the oil return feed lines originate.

In yet another embodiment of the present invention, a rotating screw pump, located within the compressor's rotating shaft, comprises two opposing flights back to back in such a way as to pump oil from both ends at the same time when necessary, or from one side at a time, and feed the oil through the oil supply holes to the surfaces that are to be lubricated.

The present invention also pertains to methods for operating an orientation and gravity insensitive oil management system.

The above summary of the present invention is not intended to describe each illustrated embodiment or every implementation of the present invention. The figures and the detailed description that follow particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
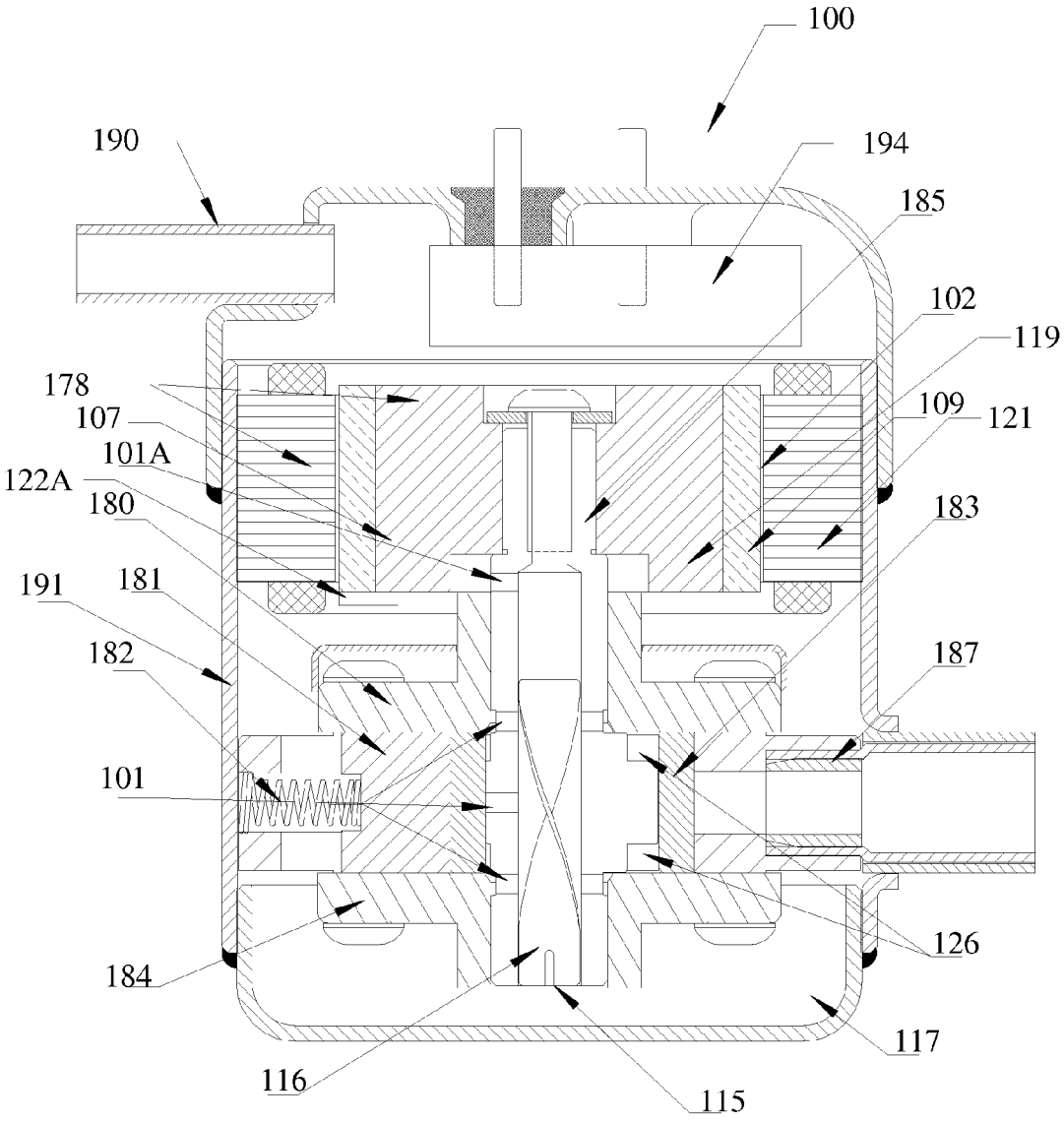
FIG. 1 schematically illustrates a prior art, state of the art miniature rolling piston compressor, described in U.S. patent application U.S. Ser. No. 11/321,354, comprising a pump assembly and a brushless DC motor, but without the integral orientation insensitive oil management system of the present invention.

While the invention is amenable to various modifications and alternative forms, specifics thereof have been shown by way of example in the drawings and will be described in detail. It should be understood, however, that the intention is not to limit the invention to the particular embodiments described for rolling piston compressor. On the contrary, the intention is to cover all modifications, equivalents, combinations and alternatives falling within the spirit and scope of the invention as defined by the appended claims.

DETAILED DESCRIPTION

The present invention pertains to an integrated internal oil management system for a fluid displacement device, such as a rotary compressor, to ensure adequate lubrication and thus enable its operation in all orientations under zero to full gravity. The fluid displacement devices referred to herein are generally oil lubricated rotary compressors, expanders, or engines including rolling piston compressors and sliding vane compressors. The present invention also pertains to methods related to the operation of the integrated internal oil management system. Although the present invention is applicable to many rotary machinery that are lubricated by oil, the description of the present invention is based, for illustrative purposes, on a miniature rolling piston type oil lubricated rotary compressor for use with primary refrigerants as the working fluid, as used in vapor compression systems. The rotary type machinery in conjunction with the oil management system of the present invention will be especially useful in applications that require operating the system in arbitrary orientations in full gravity as well as in zero to low gravity conditions. Exemplary applications include man-portable vapor compression cooling systems in terrestrial systems, and spacecraft vapor compression cooling systems in aerospace systems.

1. Definitions

The term "orientation and gravity insensitive", as used herein, refers to characteristics that enable reliable and efficient operation of machinery in all orientations with respect to the placement direction of the system and the varying levels of gravity or acceleration under which the system is operated.

The term "fluid displacement device", as used herein, refers to oil lubricated rotary or reciprocating machinery, such as compressors, expanders, engines and pumps in general. Preferably, machinery is such that its casing or housing contains one or more rotating components that can be utilized to incorporate the oil management system of the present invention within the casing or housing without increasing the size of the casing or housing.

The term "working fluid", as used herein, refers to any of the following: a refrigerant; a refrigerant and oil mixture; hydrocarbons and air mixture; gasoline or hydrocarbon fuels; combustion gases, air, nitrogen, and other gases; and vapor.

The term "drive mechanism", as used herein, refers to any of the following: a shaft that turns; a crank mechanism; and a motor.

The term "entrainment limit", as used herein, refers to refrigerant vapor flow velocity beyond which the liquid collected onto the outer surface of the tubular passages will be re-entrained by the refrigerant vapor flowing in the direction opposite from the oil flow.

The term "Miniature Rolling Piston Compressor", as used herein, refers to a prior art, state of the art miniature rolling piston compressor comprising a pump assembly and a brushless DC motor, as described in U.S. patent application Ser. No. 11/321,354, the description of which is incorporated herein.

It is to be understood that the singular forms of "a", "an", and "the", as used herein and in the appended claims, include plural reference unless the context clearly dictates otherwise.

2. Orientation and Gravity Insensitive Oil Management System

For clarity of illustration herein, a preferred embodiment of the present invention is configured and designed for, and to be incorporated within an ultra light miniature rolling piston compressor shown in FIG. 1. The oil lubricated miniature rotary compressor comprises a compressor pump assembly, a conventional oil management system capable of handling near vertical operation, a brushless DC motor 178 (comprising rotor 119 and stator 121) for driving the pump assembly, a terminal block 194, a casing 191, a discharge tube 190 and a suction tube 187. The pump assembly comprises a compression cylinder 186, a shaft (also referred to as a crankshaft) 185 having an eccentric part and being attached to the rotor 119, an upper bearing (also referred to as top flange) 180 and a lower bearing (also referred to as bottom flange) 184 supporting the shaft 185, a roller 183, a vane 181, and a vane spring 182. Shaft 185 comprises three lubricating ports 101, a vapor vent port 101A as well as an oil pick up 115 at the bottom tip of shaft 185. Shaft 185 comprises an unidirectional fluted oil pump 116. Shaft 185 and roller 183, together with bottom flange 184 and top flange 180, form internal oil reservoirs 126 to promote uninterrupted lubrication of the pump mechanisms in case the oil level in the sump 117 becomes low or the oil pickup 115 is not in contact with the oil in the sump 117 due to momentary tilting of the compressor itself. The space bounded by the bottom parts of the casing and the pump parts, comprises an oil sump 117 that supplies most of the lubrication oil through the unidirectional flute oil pump 116. An optional oil separator may be comprised on stator 121 in the air gap 102 to push back some of the oil from the outgoing refrigerant flow through the air gap 102. If the compressor is tilted beyond, for example, 30 degrees from the line of gravity, the oil pick up 115 may not be in the pool of oil, depending on the amount of oil in the sump 117, and therefore, the pump mechanism will eventually run dry and thereby causing inevitable damage unless the compressor tilting is reduced to less than 30 degrees in a short period of time, such as a few minutes or hours depending on the degree of tilting.

The oil lubricated miniature rotary compressor shown in FIG. 1 provides a high power density and efficiency. The combination of its unique features, such as its compact size, low weight, durability (particularly with a hermetic casing), and lubrication system, makes the miniature compressor well-suited for lightweight portable applications, except for the fact that, as described above, the compressor cannot be operated safely and reliably for an extended period unless it is oriented substantially vertical or, i.e., in line with direction of the gravitational force or a direction resulting from the combination of acceleration and gravity. However, the incorporation of the orientation insensitive oil management system of the present invention into this miniature compressor will enable the miniature compressor to be used in any orientation under zero to full gravity without loss of lubrication and ensuing damage or undue wear and tear stemming from lack of adequate lubrication.

Figure 2:
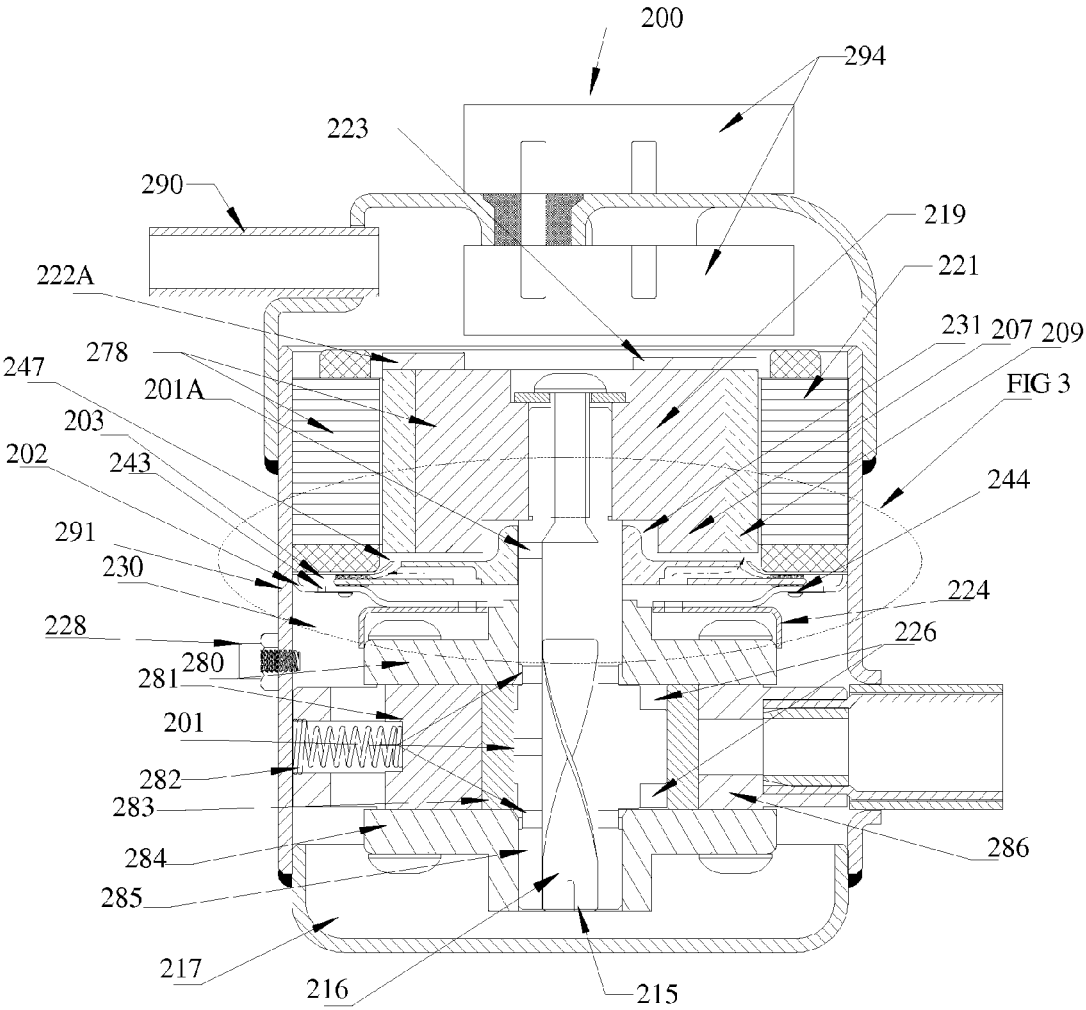
FIG. 2 illustrates a cross-sectional side view of an integral orientation insensitive oil management system, housed in a hermetically sealed miniature rolling piston compressor that is very similar to the design shown in FIG. 1, according to an embodiment of the present invention.
Figure 3:
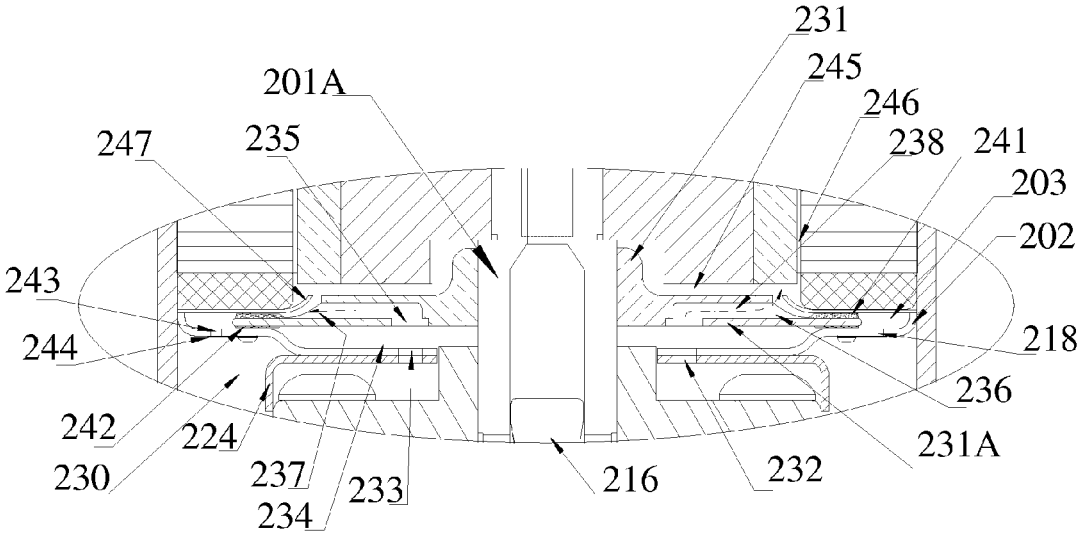
FIG. 3 illustrates an expanded view of an embodiment of the oil management system of FIG. 2 (shown via dashed lines forming an ellipse), illustrating details of the oil separator/pump, flow paths for the refrigerant and oil, and other design features of the oil pump to minimize frictional losses of the pump.

In one embodiment of the present invention, the orientation restriction problem of the state of the art compressor of FIG. 1, is overcome, as shown in FIG. 2. The new design of the hermetic rolling piston compressor 200 comprises most of the same components as the compressor shown in FIG. 1: a pump assembly (as disclosed in U.S. Ser. No. 11/321,354), a brushless DC motor 278 (comprising rotor 219 and stator 221, rotor 219 comprising iron core 207 and magnet 209), a terminal block 294, and a casing 291. The pump assembly comprises compressor cylinder 286, a shaft (also referred to as a crankshaft) 285 having an eccentric part, an upper bearing (also referred to as top flange) 280 and a lower bearing (also referred to as bottom flange) 284 supporting shaft 285, a roller 283, a vane 281, and a vane spring 282. Shaft 285 and roller 283, together with bottom flange 284 and top flange 280, form internal oil reservoirs 226 to promote uninterrupted lubrication of the pump mechanisms in case the oil level in the sump 217 becomes low or the oil pickup 215 is not in contact with the oil in the sump 217 due to momentary tilting of the compressor itself. The distinguishing aspect of the present invention's design from that of the state of the art compressor illustrated in FIG. 1 is an advanced oil management system that can handle all orientations and varying gravity levels. An important component of this novel oil management system, illustrated in FIG. 2, is an oil dam 202 that separates the space within the hermetic casing 291 into two sections with respect to the oil. The space below the oil dam 202 bounded by the casing 291 and the pump parts, defines the oil reservoir space 230, which includes the traditional oil sump 217, as illustrated in FIG. 2. The space above the oil dam 202 and below the brushless DC motor 278 defines the oil separation space, and comprises a centrifugal oil separator/pump 231. In order to locate the oil separator/pump 231 here, the balancing weight 122A (shown in FIG. 1) is relocated to the top of the rotor 219 and is referred to as balancing weight 222A (shown in FIG. 2). An additional balancing weight 223 is preferably included. This design also comprises an optional oil reservoir access plug 228 in casing 291 that enables direct charging and drainage of oil in the oil reservoir space 230. The access plug 228 is an optional feature for a hermetic compressor to facilitate the quick and easy removal of oil from the compressor or charging of oil into the compressor without involving or contaminating the rest of the refrigeration system. Even without the oil reservoir access plug 228, the oil inside the compressor 200 can be removed by running the compressor at a low enough speed for the oil separation effectiveness to be significantly reduced. Most of the oil can be pumped out of the compressor chamber if operated below the lower limit of normal operating speed range due to lower separation effectiveness. The start-up sequence for the compressor 200 after a long period of inaction would be to initially operate the compressor briefly at very slow speeds to rid the compressor of the oil seeped into the chamber from the oil reservoir space 230 through various paths. This step will reduce the maximum torque and thus maximum current requirement for starting the motor 278 by removing the liquid trapped in the compressor 200 prior to running the compressor at normal operational speed. Also, the compressor 200 can be drained of used oil and charged with fresh oil by introducing the oil through port for oil reservoir access plug 228. The remainder of the oil management system, shown in FIG. 2, comprises a unidirectional, self-priming bottom oil pick up 215, similar to that of the compressor 100 shown in FIG. 1, within the rotating shaft; a centrifugal oil pump at the periphery of the oil separator/pump 231; a circular oil manifold 203 near the periphery of oil dam 202 (bounded by the bottom of the stator 221, oil dam 202 and oil separator/pump 231); an oil return port 243, and a check valve 244 for each oil return port 243. The detailed flow path of the present oil management system is described using FIG. 3, which shows the expanded view of its components. Starting from the discharge muffler 224, refrigerant/oil mixture exits through muffler discharge port 232, travels through oil dam refrigerant/oil discharge port 233, enters the oil separator inlet manifold 234, which is sized large enough to facilitate the flow of refrigerant/oil mixture into the rotating oil separator/pump 231 through the centrifugal oil separator inlet 235. Once inside the separator inlet 235, the mixture flows toward the periphery while the oil separator/pump 231 spins, and the oil droplets become separated from the refrigerant via centrifugal force in the oil separator/pump 231 aided by impellers 236 mounted on the flat rotating disk 231A of oil separator/pump 231. Thus, oil droplets follow oil droplet path 237, while the refrigerant vapor follows the refrigerant path 238 and exits via at least one hole 218. The oil droplets are guided by oil droplet guide 247 and reach the upper liquid pump impeller 241 that pumps the separated oil droplets into the oil collection manifold 203 aided by the upper liquid pump impeller 241, which can be raised ridges or fins on the upper surface of the rotating disk 231A. The oil droplet guide 247 and oil dam 202 are preferably fabricated as one piece so as to maintain dimensional tolerances and clearances required by the upper liquid pump impeller 241 and lower liquid pump impeller 242. Some portion of the refrigerant/oil flow in the oil separator inlet manifold 234 will impinge on the bottom surface of the oil separator/pump 231 and because the surface is rotating, oil droplets will be inclined to flow spirally outward toward the lower liquid pump impeller 242. The lower liquid pump impeller 242 also acts as a deterrent to oil backflow from oil collection manifold 203 to oil separator inlet manifold 234. When the pressure buildup in the oil collection manifold 203 reaches a level sufficient to overcome the spring loading of check valve 244, the oil from oil collection manifold 203 returns to the oil reservoir space 230 via the oil return port 243. From the oil reservoir space 230, the oil reaches the internal parts of the compressor 200 via the oil pick up 215, the flute pump 216 in the middle of the shaft 285, and three oil supply holes 201, as shown in FIG. 2. Vapor vent hole 201A, located in the oil separation space, ensures the venting of any trapped air or gas inside the shaft 285. The oil also reaches the internal parts of the compressor 200 via the slot for vane 281 (shown in FIG. 2), due to the fact that oil supply pressure in the oil reservoir space 230 is typically above the internal compressor chamber pressure throughout the cycle. As for the refrigerant, it follows refrigerant flow path 238 and enters into submotor refrigerant manifold 245, which is sized large enough to promote the refrigerant flow from which the refrigerant flows through the gap 246 between the rotor 219 and the stator 221, and finally exits from the compressor casing 291 through discharge tube 290 (shown in FIG. 2).

In one embodiment of the present invention, the system is an innovative and integral, closed loop pressurized oil management system with the following features:

(a) A pressurized oil management loop within the existing compressor casing, achieved with the use of an oil dam, oil separator, oil pump and oil return paths to keep the lubrication circulating regardless of orientation or gravity field. This feature provides the following advantages:
   i. Insensitivity to orientation of the axis with respect to lubrication, resulting in omni directional operation capability in varying degree of gravity.
   ii. Higher heat exchanger effectiveness, higher capacity of the heat exchangers and higher refrigeration capacity of the cooling system, more compact overall system size for the same cooling performance, and etc., achieved as a result of drastically reducing the oil entrainment in the refrigerant.

(b) An oil separator and an oil pump incorporated within the casing of the compressor without increasing the size of the compressor casing, and placed in a space largely unused previously.

(c) Both the oil separator and oil pump incorporated into a single contiguous component driven by the existing motor shaft.

Similar feats could be achieved by placing the oil separator and pump within the rotor of the brushless DC motor to separate the oil and then pump the separated oil back to the oil reservoir space. Two different embodiments of the present invention for in-rotor oil separators are described below. Also, it is possible to pump back the separated oil directly into the compressor pump parts rather than into the oil reservoir space. Examples showing three of the potential six combinations in terms of the location of the separator/pump (inside the rotor or outside the rotor), design of the in-rotor separator/pump (simple vs. articulated), oil return paths (direct injection through new lubricating paths utilizing a double acting flute pump within the shaft vs. returning to oil reservoir space utilizing a conventional unidirectional flute pump within the shaft) are shown in FIG. 4 through FIG. 9. The other three combinations not described herein should be obvious to those versed in art without necessitating further illustrations herein.

Figure 4:
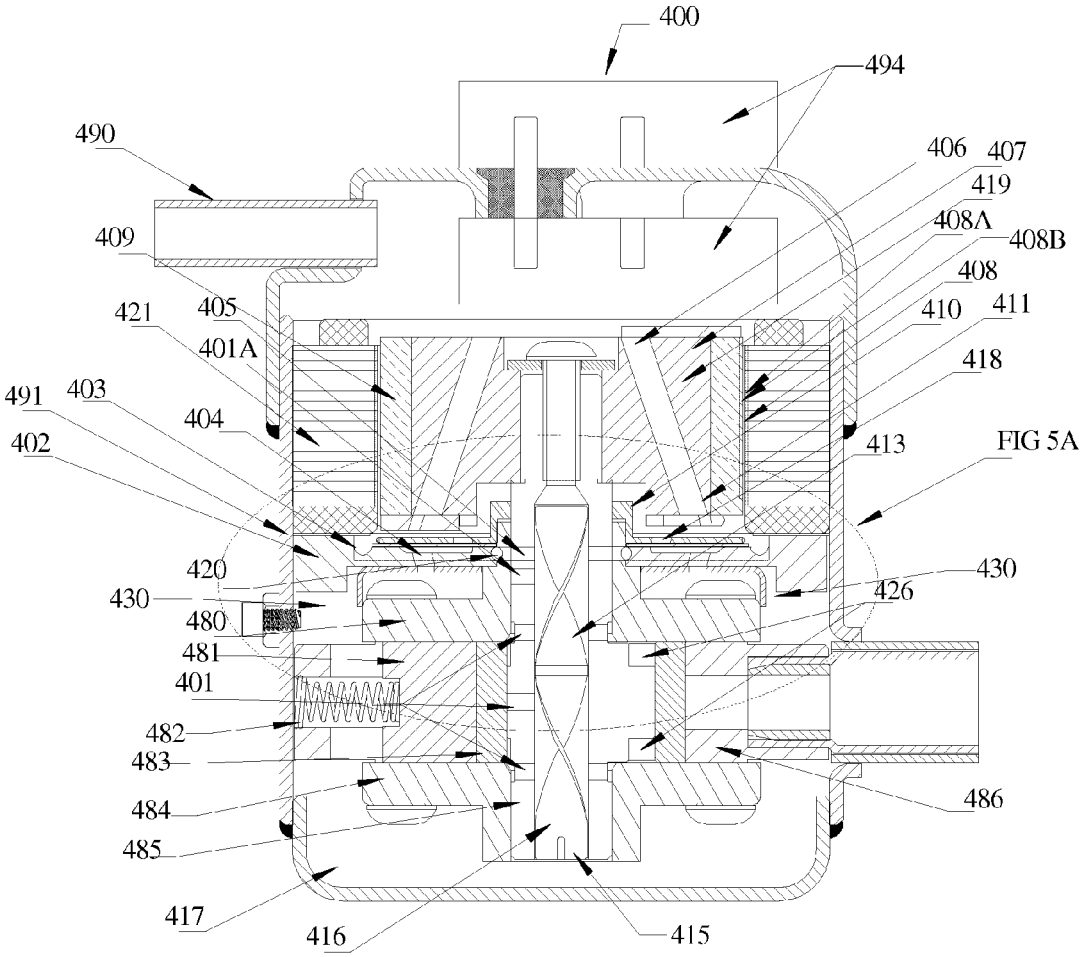
FIG. 4 illustrates a cross-sectional side view of an integral, orientation insensitive oil management system housed in a hermetically sealed oil lubricated rolling piston compressor, according to an embodiment of the present invention.

In an embodiment of the present invention, as shown in FIG. 4, a hermetic rolling piston compressor assembly 400 comprises a pump assembly, a brushless DC motor (comprising rotor 419 and stator 421; rotor 419 comprising iron core 407 and magnet 409), oil management system of the present invention, a terminal block 494, and a casing 491. The pump assembly comprises a compressor cylinder 486, a shaft (also referred to as a crankshaft) 485 having an eccentric part, an upper bearing (also referred to as top flange) 480 and a lower bearing (also referred to as bottom flange) 484 supporting the shaft 485, a roller 483, a vane 481, and a vane spring 482. Shaft 485 comprises three lubricating ports 401, a vapor vent port 401A, oil return port 405, and a bottom oil pickup 415 at the bottom tip of shaft 485. Shaft 485 comprises a lower fluted oil pump 416 and an upper fluted oil pump 413, both of which are rotating in the same direction with the shaft 485, although the pumps pump oil in opposite directions from two different oil sources against each other. Shaft 485 and roller 483, together with the bottom flange 484 and top flange 480, form the internal oil reservoirs 426 to promote uninterrupted lubrication of the pump mechanisms in the event that the oil level in the sump 417 becomes low or the oil pickup 415 is not in contact with the oil in the sump 417 due to momentary tilting of the compressor 400 itself. The space within the compressor casing 491 is separated into two sections by oil dam 402 as far as oil is concerned (similar to the example shown in FIG. 2). The space below oil dam 402, bounded by the casing 491 and the pump parts, comprises the oil reservoir space 430, which includes the traditional oil sump 417. The space inside of the casing 491 above oil dam 402 comprises three oil separators: 1) rotor cavity oil separator 406 (refrigerant outlet)—and 411 (refrigerant and oil mixture inlet and oil outlet), 2) air gap oil separator 408A on stator 421 and/or air gap oil separator 408B on rotor 419), and 3) rotating disk oil separator pump 410. The rotor cavity oil separators 406 and 411 ("406-411") of this embodiment are a straight through cavity version. Oil dam 402 comprises two oil manifolds: an outer oil collection manifold 403 and an inner oil collection manifold 420. The outer oil collection manifold 403 receives the oil pumped by the rotating disk oil pump 410. The inner oil collection manifold 420 is connected to the oil return port 405, which port in turn feeds the upper fluted oil pump 413.

Figure 5A:
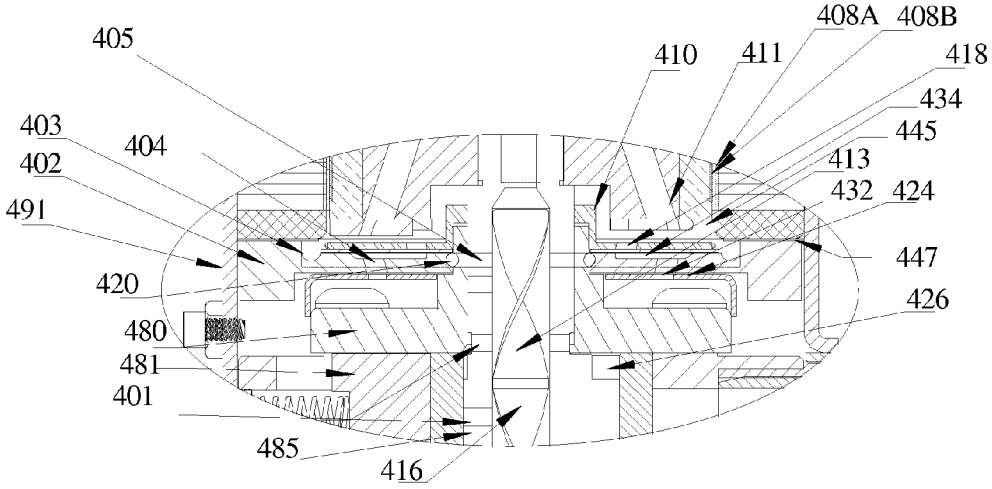
FIG. 5*a* illustrates an expanded view of an embodiment of the oil management system illustrated in FIG. 4 (shown via dashed lines forming an ellipse), illustrating details of the oil separator, disk shaped centrifugal oil pump, flow paths for the refrigerant and oil, and other design features of the oil pump to minimize frictional losses of the pump.

In the prior art, shown in FIG. 1, a compressor assembly contains a rotor 119 consisting of a permanent magnet 109 and a ring shaped iron rotor core 107 that holds and supports the permanent magnet 109. The rotor core 107 provides the paths for the magnetic flux lines for the magnets. In a typical prior art motor, the iron core 107 is fabricated from a solid ring without holes, as shown in FIG. 1. In one embodiment of the present invention, as shown in FIG. 4, the iron core 407 of rotor 419 comprises a set of tilted holes 406 and 411, rotor cavity oil separator 406 (refrigerant outlet)-411 (refrigerant and oil mixture inlet and oil outlet), drilled in the rotor iron core 407 of rotor 419 in such a way that the iron core 407 comprising tilted holes 406-411 still provides sufficient magnetic flux paths and structural support. The tilted holes 406-411 may be tilted both in the direction of the rotation and radially decreasing as viewed from the bottom of the rotor toward the top of the rotor at an angle with respect to the vertical axis. The tilted holes 406-411 form tubular passages in the rotor. The tilted holes 406-411 contain the mixture of refrigerant vapor and oil; and when the rotor rotates, the tilted holes also rotate, thus creating essentially a centrifugal oil separator within the rotor. In such a configuration, the tilted holes function as oil separators by collecting the oil droplets that have density higher than the carrier fluid (in this case, refrigerant vapor) and are being slung onto the surfaces of the tubular passages away from the center of rotation. Then, the centrifugal force generated by the rotation of the rotor and tubular passages will push the liquid film down the tubular passages in the direction opposite from the refrigerant vapor flow. The diameter of these holes and the number of the holes are configured so as to allow the flow velocity to be lower than the entrainment limit in the tilted tubular passages. In other words, the flow velocity of the refrigerant vapor flowing in the tilted tubular passages toward the rotor separator oil discharge 411 is low enough not to re-entrain the separated oil that is being pushed back down the tilted tube toward the rotating oil pump. In this embodiment, there are two potential paths for the compressed refrigerant vapor to travel past the brushless DC motor section to reach the discharge tube. Referring to FIG. 4 and FIG. 5*a*, these paths are:

1. A set of relatively large flow area, rotor separator refrigerant intake holes 411 in the iron core 407 of rotor 419 circumferentially located near the inner edge of the iron core 407 of rotor 419. The path through tubular passages 406-411 have a larger flow area and lower flow resistance for the oil vapor laden-refrigerant vapor than the path 2 below.
2. The relatively small radial air gap 408 between the stator lamination stack and the rotor magnet.

Due to the fact that the rotor separator refrigerant intake holes 411 collectively have much larger flow area and lower flow resistance than the air gap 408, this set of tubular passages 406-411 constitute the primary path for the oil-containing compressed refrigerant vapor through which vast majority (e.g., greater than 95%) of oil carrying compressed refrigerant vapor will pass. The stator/rotor air gap 408 represents a much smaller fraction (e.g., less than 5%) of the overall flow path for the refrigerant, and even in this smaller flow, most of the entrained oil in the less than 5% flow will be separated from the refrigerant flow through the air gap 408 by the tilted groove shaped oil separators 408A formed by the stator lamination stack provided on the inner diametral surface of the stator 421 or oil separators 408B provided on the outer diametral surface of the core 407 of rotor 419.

Referring to FIG. 4 and FIG. 5*a*, the oil laden compressed refrigerant vapor comes out from the top flange 480, and travels through the following paths: a set of holes 432 in the muffler 424, then the refrigerant discharge holes 404 in the oil dam 402, refrigerant discharge manifold 434, refrigerant discharge holes 418 in the rotating disk centrifugal oil pump 410, submotor manifold 445, rotor separator refrigerant intake 411, rotor separator refrigerant discharge 406, space below the top cap of casing 491, and finally the discharge tube 490. The oil laden compressed refrigerant vapor, as it enters the tilted radial holes 406-411 will experience a strong centrifugal force due to the rotational motion of the rotor, and because oil has much higher density than the refrigerant, it will tend to collect on the outer or peripheral side of the tubular passages 406-411. Because tubular passages 406-411 are tilted radially, decreasing from the intake side 411 at the bottom to the discharge side 406 at the top of the core 407 of rotor 419, any liquid being separated from the refrigerant due to centrifugal force and pushed to the outer surfaces of the tubular passages will be pushed downward toward the refrigerant intake holes 411, which double as oil return holes. In this case, the single set of holes 406-411 will act as refrigerant-oil mixture intake, oil return and refrigerant discharge all at the same time. Also, one or more optional separator vanes (not shown) can be attached at the bottom of the rotor to promote oil separation; however, the increased aerodynamic friction will have to be taken into consideration to prevent any undesirable increase in power consumption by the compressor.

Figure 5B:
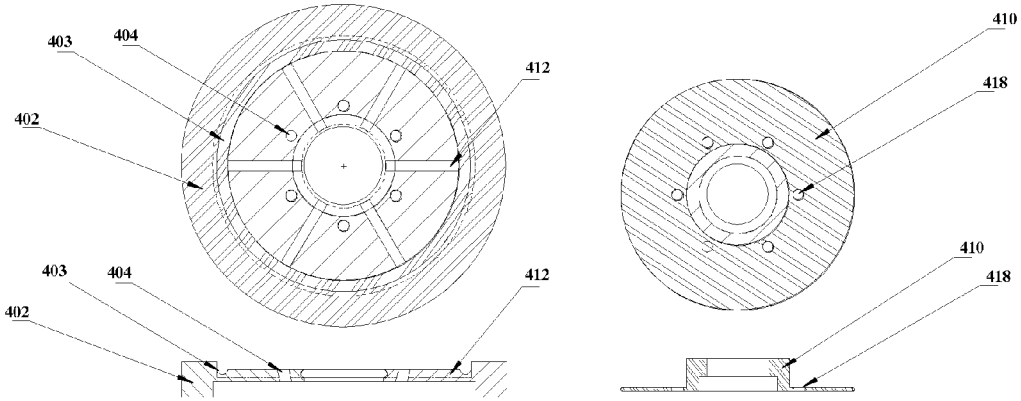
FIG. 5*b* is an expanded view illustrating the details of the oil dam and the disk shaped centrifugal oil pump including flow passages.

Immediately below the oil return holes 411 of the oil separator embedded in the iron core 407 of rotor 419, shown in FIG. 5*a*, there is a rotating disk centrifugal pump 410 connected to the rotating shaft 485. The rotating disk centrifugal pump 410 comprises a set of holes 418 (e.g., six, as shown in FIG. 5*b*) located circumferentially near the rotating shaft to allow the compressed refrigerant vapor from the compressor pump section to readily pass through, toward the oil separator in the rotor with minimal flow resistance. These holes 418 can be perpendicular to the plane of the disk or they can be tilted circumferentially either in the direction of rotation or against the direction of rotation in consideration of lowering flow resistance or increasing oil droplet capture efficiency. The holes 418 can also be tilted radially to promote oil separation. The centrifuged liquid drops are pushed toward the bottom and ejected from the nozzles of the oil separators, and the liquid dropped on the rotating disk is pushed outward in an expanding spiral, and eventually pushed in the outward radial direction by a rotating disk oil pump 410 below the nozzles at the bottom end of holes 411. As shown in FIG. 4 and FIG. 5*a*, the rotating disk oil pump 410 extends up to just under the bottom of the stator 421 or could be extended into the oil collection manifold 403. On the one hand, if the distance of the disk immersed in the oil inside of the oil collection manifold 403 is excessive, the viscous damping loss due to the high rotational speed of the rotating disk oil pump 410 will increase. On the other hand, if the distance is zero, then the only oil pumping pressure will be mostly generated through the energy conversion from dynamic (both circumferential and radial motion of the fast rotating oil layer on the disk) to static head pressure of the oil being pumped within the groove, which may or may not be sufficient to push the oil into the circular oil collection manifold 403. The bottom of the stator 421 is covered by a thin and circular bottom plate 447 to guide the oil being pushed into the gap between the rotating disk oil pump 410 and the bottom of the stator 421, and eventually into the oil collection manifold 403. The rotation of the rotating disk oil pump 410 generates a flow of collected oil into the gap spiraling away from the tip of the rotating disk oil pump 410. The oil being pushed into the gap flows into the outer oil collection manifold 403 that feeds the pressurized oil into the compressor pump parts through oil supply paths 412 (shown in FIG. 5*b*), also referred to as radial grooves 412, that emanate from the outer oil collection manifold 403 and extending to the inner oil collection manifold 420, and oil return port 405 near the spin axis. The dynamic pressure of the liquid flowing into the groove rotating at high speed turns into a static pressure in the outer oil collection manifold 403 that is used to pump the oil into the return port 405. In other words, this oil pump is self-priming. When the oil is introduced into the internal parts of the compressor for lubrication purpose, the oil is mixed into the refrigerant. When the compressor discharges the oil/refrigerant vapor, the oil separators in the iron core 407 of rotor 419 and the rotor stator air gap 408 separate the oil, and the rotating disk oil pump 410 sends the oil back to the compressor pump section. This is a pressurized loop oil management system embedded inside of the Miniature Rolling Piston Compressor 400, and keeps most of the oil within the compressor; very little oil travels outside the casing of the compressor and into the heat exchangers and other components of the refrigeration system, and thereby increasing the efficiency and cooling capacity of the refrigeration system.

The following description is provided to summarize the overall paths and management scheme for the lubricating oil in the compressor of this embodiment:

1. The oil reservoir space 430—the primary oil reservoir in the lower portion of the compressor assembly below the oil dam. The oil reservoir space is maintained almost always full and kept slightly above the discharge pressure during most of the operation.
2. The oil separation space—the upper half of the compressor, which is also at discharge pressure, is separated from the oil reservoir space in the lower half of the compressor by the oil dam 402. The upper half is largely devoid of oil, except what remains in the discharge refrigerant flow after the series of oil separation.

3. Lubricating oil from the oil reservoir space enters the compression chamber through:
   a. Vane slot as part of the effort to lubricate the vane from the traditional oil sump 417, which is part of oil reservoir space 430. For part of the cycle during which the pressure inside the compression chamber is lower than discharge pressure, the oil tends to seep into the compression chamber.
   b. Three oil supply holes 401 in shaft 485 are fed by the lower screw pump 416 pumping oil from the oil sump 417. These holes provide lubrication for interface between shaft 485 and roller 483, as well as internal oil reservoirs 426 that help lubricate the contact area between the shaft 485 and the roller 483, as well as the contact area between the roller 483 and the top flange 480 and the bottom flange 484.
   c. Lubricating oil enters the compressor from the oil return port 405, which is fed by the inner oil collection manifold 420 in the oil dam 402, which is in turn fed by the outer oil collection manifold 403 through radial grooves 412, as shown in FIG. 5*b*.
4. Once the lubrication oil is inside the pump mechanism, it travels into the compression chamber into which intake refrigerant enters and is mixed with the oil that has infiltrated. During the discharge process, the oil contained in the refrigerant vapor is separated and pumped back to the compressor pump section via the oil return port 405.

The arrangement of the oil management system embodiment described above facilitates the filtering or separating of the oil from the refrigerant stream traveling out of the compressor, and thereby reducing the oil circulation in the rest of the refrigeration system. Lower oil content in the refrigerant in the refrigeration system outside of the compressor has many advantages, such as higher effectiveness of heat exchangers, lower pressure drop in various flow paths, lower power consumption, higher capacity, higher efficiency, and a more stable oil level in a smaller oil sump, which can translate into smaller compressor assembly and higher specific capacity.

Figure 6:
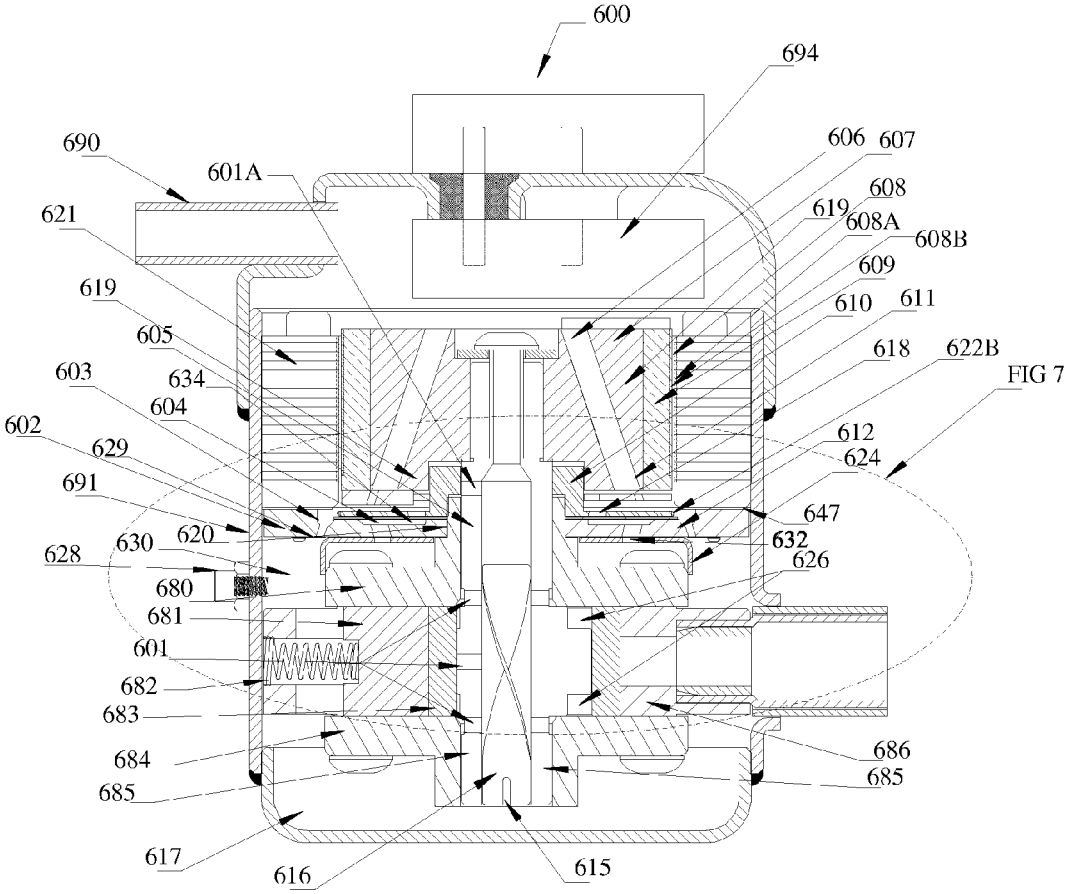
FIG. 6 illustrates a cross-sectional side view of an integral, orientation-insensitive oil management system comprised in a hermetically sealed miniature rolling piston compressor, according to an embodiment of the present invention.
Figure 7:
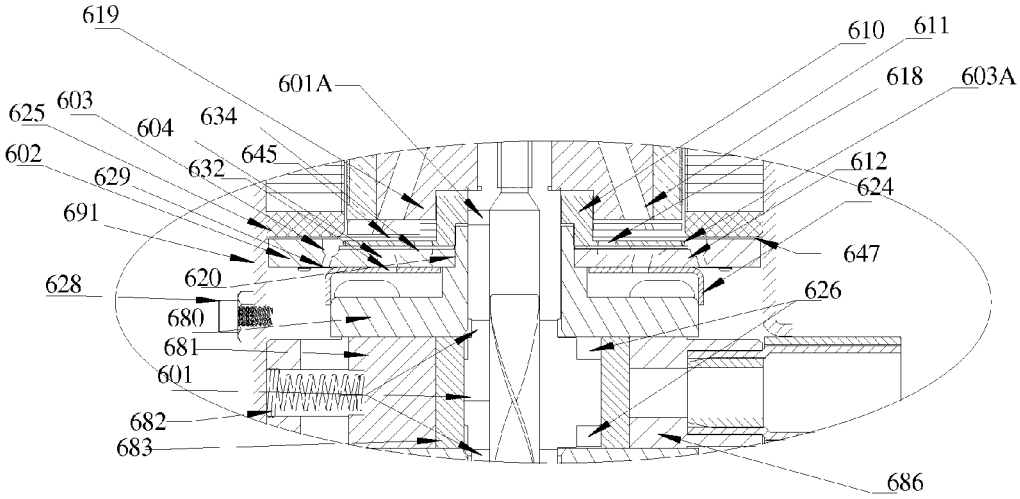
FIG. 7 illustrates an expanded view of an embodiment of the oil management system illustrated in FIG. 6 (shown via dashed lines forming an ellipse), illustrating details of the oil separator, disk shaped centrifugal oil pump, flow paths for the refrigerant and oil, and other design features of the oil pump to minimize frictional losses of the pump.

In another embodiment of the present invention, as shown in FIG. 6 and FIG. 7, a hermetic rolling piston compressor assembly 600 comprises a pump assembly, a brushless DC motor (comprising rotor 619 and stator 621; rotor 619 comprising iron core 607 and magnet 609), an oil management system of the current embodiment of the present invention, a terminal block 694, and a casing 691. The pump assembly comprises compressor cylinder 686, a shaft (also referred to as a crankshaft) 685 having an eccentric part, an upper bearing (also referred to as top flange) 680 and a lower bearing (also referred to as bottom flange) 684 supporting shaft 685, a roller 683, a vane 681, and a vane spring 682. Shaft 685 comprises three lubricating ports 601, a vapor vent port 601A, and a bottom oil pickup 615 at the bottom tip of shaft 685. Within shaft 685, there is a unidirectional screw oil pump 616, which is identical to the design shown in FIG. 1. Shaft 685 and roller 683, together with bottom flange 684 and top flange 680, form internal oil reservoirs 626 to promote uninterrupted lubrication of the pump mechanisms in the event that the oil level in the sump 617 becomes low or the oil pickup 615 is not in contact with the oil in the sump 617 due to momentary tilting of the compressor itself. The space within the hermetic casing is separated into two sections, with respect to oil, by oil dam 602, as shown in FIG. 6. The oil reservoir space 630 comprises the space below oil dam 602 bounded by the casing 691 and the pump parts, and includes the traditional oil sump 117 of FIG. 1. The oil separation space, space inside of the casing above oil dam 602, comprises three oil separators rotor cavity oil separator 606 (refrigerant outlet) and 611 (oil outlet and refrigerant oil mixture inlet), 2) a oil separator 608A on stator 621 and/or air gap oil separator 608B on rotor 619, and 3) rotating disk oil pump 610. The rotor cavity oil separator 606 of this embodiment is a straight-through cavity version. Oil dam 602 comprises one oil manifold 603, comprising a seal 603A at its top. Oil collection manifold 603 receives the oil pumped by the rotating disk oil pump 610, as shown in FIG. 6. Oil collection manifold 603 connects to the oil reservoir space 630 via a check valve 629. Below oil dam 602, the oil reservoir space is pressurized slightly above the discharge pressure, and the conventional oil lubrication systems described in FIG. 1 takes over to provide lubrication to compressor parts. The only difference between the present embodiment and the conventional sump system, as shown in FIG. 1, is that the oil reservoir space 630 is almost always full and pressurized so that there is no lack of lubrication in any orientation under any gravitational field.

In the prior art shown in FIG. 1, a compressor assembly contains a rotor 119 consisting of a permanent magnet 109 and a ring shaped iron rotor core 107 that holds and supports the permanent magnet 109. The rotor core 107 provides the paths for the magnetic flux lines for the magnets. In a typical prior art motor, the iron core 107 is fabricated from a solid ring, as shown in FIG. 1. In one embodiment of the present invention, as shown in FIG. 6 and FIG. 7, the iron core 607 comprises a set of tilted tubular passages 606 and 611 ("606-611"); the rotor cavity oil separator 606 (refrigerant outlet)-611 (refrigerant and oil mixture inlet and oil outlet) are drilled in the iron core 607 of rotor 619 in such a way that the iron ring comprising tilted tubular passages 606-611 still provides sufficient magnetic flux paths and structural support. The tilted tubular passages 606-611 may be tilted both in the direction of the rotation and radially decreasing, as viewed from the bottom of the rotor toward the top of the rotor at an angle with respect to the vertical axis. The tilted tubular passages 606-611 contain the mixture of refrigerant vapor and oil; and when the rotor rotates, the tilted holes also rotate, thus essentially creating a centrifugal oil separator within the rotor. In such a configuration, the tilted tubular passages 606-611 function as oil separators by collecting the oil droplets that have density higher than the carrier fluid (in this case, refrigerant vapor) and are being slung onto the surfaces of the tubular passages 606-611 away from the center of rotation Then, the centrifugal force generated by the rotation of the tubular passage will push the liquid film down the tube in the direction opposite from the refrigerant vapor flow. The diameter of these holes and the number of the holes are configured so as to allow the flow velocity to be lower than the entrainment limit in the tilted tubular passages. In other words, the flow velocity of the refrigerant vapor flowing in the tilted tube toward the rotor separator oil discharge 611 is low enough not to re-entrain the separated oil that is being pushed back down the tilted tube toward the rotating oil pump. In this embodiment, there are three potential paths for the compressed refrigerant vapor to travel past the brushless DC motor section to reach the discharge tube. Referring to FIG. 6 and FIG. 7, these paths are:

1. A set of relatively large flow area, rotor separator refrigerant intake holes 611, which are also used for rotor separator oil discharge, in the rotor iron core circumferentially located near the inner edge of the rotor iron core. The path through tubular passages 606-611 has the larger flow area and lower flow resistance for the oil vapor laden-refrigerant vapor than the path 2 below.

2. The relatively small radial air gap 608 between the stator lamination stack and the rotor magnet 609.

Due to the fact that the rotor separator refrigerant intake holes 611 collectively have much larger flow area and lower flow resistance than the air gap 608, this set of tubular passages 606-611 constitute the primary path for the oil-containing compressed refrigerant vapor through which vast majority (e.g., greater than 95%) of oil carrying compressed refrigerant vapor will pass. The stator/rotor air gap 608 represents a much smaller fraction (e.g., less than 5%) of the overall flow path for the refrigerant, and even in this case, most of the entrained oil from the less than 5% flow is separated from the refrigerant flow through the air gap 608 by the tilted groove shaped oil separators 608A on the stator stack, formed by the stator laminated stack on the inner diametral surface of the stator 621, or oil separators 608B on the outer diametral surface of the iron core 607 of rotor 619.

Referring to FIG. 6 and FIG. 7, the oil laden compressed refrigerant vapor comes out near the top of the cylinder 686, and travels through the following paths: a set of holes 632 in muffler 624, then the refrigerant discharge holes 604 (also functioning as oil return port) in oil dam 602, refrigerant discharge manifold 634, refrigerant discharge holes 618 in the rotating disk centrifugal oil pump 610, submotor refrigerant manifold 645, rotor separator refrigerant intake 611, rotor separator refrigerant discharge 606, space below the top cap of casing 691, and finally the discharge tube 690. The oil laden compressed refrigerant vapor, as it enters the tilted tubular passages 606-611, will experience a strong centrifugal force due to the rotational motion of the rotor and, as oil has much higher density than the refrigerant, will tend to collect on the outer or peripheral side of the tubular passages 606-611. Because the tubular passages 606-611 are tilted radially, decreasing from the intake side 611 at the bottom to the discharge side 606 at the top of the rotor core 607, any liquid being separated from the refrigerant due to centrifugal force and pushed to the outer surfaces of the holes will be pushed downward toward the rotor separator oil discharge holes 611. In this case, the single set of tubular passages 606-611 will act as refrigerant oil mixture intake, oil return and refrigerant discharge all at the same time. Also, one or more optional separator vanes (not shown) can be attached at the bottom of the rotor to promote oil separation; however, the increased aerodynamic friction will have to be taken into consideration to prevent any undesirable increase in power consumption by the compressor.

Immediately below the oil outlet holes 611 of the oil separator embedded in the iron core 607 of rotor 619, there is a rotating disk centrifugal pump 610 connected to rotating shaft 685. The rotating disk centrifugal pump 610 comprises a set of holes 618 (e.g., six, as shown in FIG. 5*b*) located circumferentially near the rotating shaft to allow the compressed refrigerant vapor from the compressor pump section to readily pass through toward the oil separator in the rotor with minimal flow resistance. These holes 618 can be perpendicular to the plane of the rotating disk centrifugal pump 610 or they can be tilted circumferentially either in the direction of rotation or against the direction of rotation in consideration of lowering flow resistance or increasing oil droplet capture efficiency. The holes 618 can be also tilted radially to promote oil separation. The centrifuged liquid drops are pushed toward the bottom and ejected from the nozzles of the oil separators, and the liquid dropped on the rotating disk is pushed outward in an expanding spiral and eventually pushed in the outward radial direction by the rotating disk centrifugal pump 610 below the nozzles at the bottom end of oil return holes 611. As shown in FIG. 6 and FIG. 7, the rotating disk centrifugal pump 610 extends up to just under the bottom of stator 621, or it could be extended into the oil collection manifold 603. The radial overlap distance can be between zero (as shown) and a portion of the oil collection manifold 603. On the one hand, if the distance of the disk immersed in the oil inside of oil collection manifold 603 is excessive, the viscous damping loss due to the high rotational speed of the disk will increase. On the other hand, if the distance is zero, then the only pumping pressure will be mostly generated through the energy conversion from dynamic (both circumferential and radial motion of the fast rotating oil layer on the disk) to static head pressure of the oil being pumped within the groove, which may or may not be sufficient to maintain the oil pressure in the oil collection manifold 603. The bottom of stator 621 is covered by a thin and circular bottom plate 647 to guide the oil being pushed into the gap between the rotating disk centrifugal pump 610 and the bottom of the stator 621, and eventually into oil collection manifold 603. The rotation of the rotating disk centrifugal pump 610 generates a flow of collected oil into the gap spiraling away from the tip of the rotating disk centrifugal pump 610. The oil being pushed into the gap flows into a circular oil collection manifold 603 that serves to feed the pressurized oil into the compressor pump parts through oil supply paths 612 (also referred to as radial grooves 612) that emanate from the circular groove shaped manifold 603 and extending to the oil supply groove 620, and supply holes 601 (also referred to as three lubricating ports 601) near the spin axis. The dynamic pressure of the liquid flowing into the groove rotating at high speed turns into a static pressure in the oil collection manifold 603 that is used to pump the oil into the supply holes 601. In other words, this oil pump is self-priming. When the oil is introduced into the internal parts of the compressor for lubrication purpose, the oil is mixed into the refrigerant. When the compressor discharges the oil/refrigerant vapor, the oil separators in the rotor iron and the rotor stator air gap separate the oil, and the rotating disk oil pump sends the oil back to the compressor pump section. This is a pressurized loop oil management system embedded inside of the Miniature Rolling Piston Compressor and keeps most of the oil within the compressor; very little oil travels from the compressor and into the heat exchangers and other components of the refrigeration system, and thereby increasing the efficiency and even capacity of the refrigeration system.

The following description is provided to illustrate the overall paths and management scheme for the lubricating oil in the compressor of one embodiment:

1. The oil reservoir space 630—the primary oil reservoir in the lower portion of the compressor assembly below the oil dam 602. The oil reservoir space is maintained almost always full and kept slightly above the discharge pressure during most of the operation.
2. The oil separation space—the upper half of the compressor above the oil dam 602, which is also at discharge pressure, is separated from the oil reservoir space (in the lower half of the compressor) by the oil dam 602. The upper half of the compressor is largely devoid of oil, except what remains in the discharge refrigerant flow after the series of oil separation.
3. Lubricating oil from the oil reservoir space enters the compression chamber through:
   a. Vane slot as part of the effort to lubricate the vane from the traditional oil sump 617, which is part of oil reservoir space 630. For part of the cycle during which the pressure inside of the compression chamber is lower than discharge pressure, the oil tends to seep into the compression chamber.

b. Three oil supply holes 601 in shaft 685 are fed by the lower fluted pump 616 pumping oil from the oil sump 617. These holes 601 provide lubrication for interface between shaft 685 and roller 683, as well as internal oil reservoirs 626 that help lubricate the area between the shaft 685 and the roller 683, as well as the top flange 680 and the bottom flange 684.

c. Lubricating oil enters the compressor from the oil return port 604, which is fed by the inner oil collection manifold 620 in the oil dam 602, which is in turn fed by the outer oil collection manifold 603 through radial grooves 612.

4. Once the lubrication oil is inside the pump mechanism, it travels into the compression chamber into which intake refrigerant enters and is mixed with the oil that has infiltrated. During the discharge process, the oil contained in the refrigerant vapor is separated and pumped back to the compressor pump section via the oil return port 604.

The arrangement of the oil management system embodiment described above facilitates the filtering or separating of the oil from the refrigerant stream traveling out of the compressor, and thereby reducing the oil circulation in the rest of the refrigeration system. Lower oil content in the refrigerant in the refrigeration system outside of the compressor provides many advantages, such as higher effectiveness of heat exchangers, lower pressure drop in various flow paths, lower power consumption, higher capacity, higher efficiency, and a more stable oil level in a smaller oil sump, which can translate into smaller compressor assembly and higher specific capacity as well as higher capacity of the cooling system, and more compact system for the same cooling performance.

Figure 8:
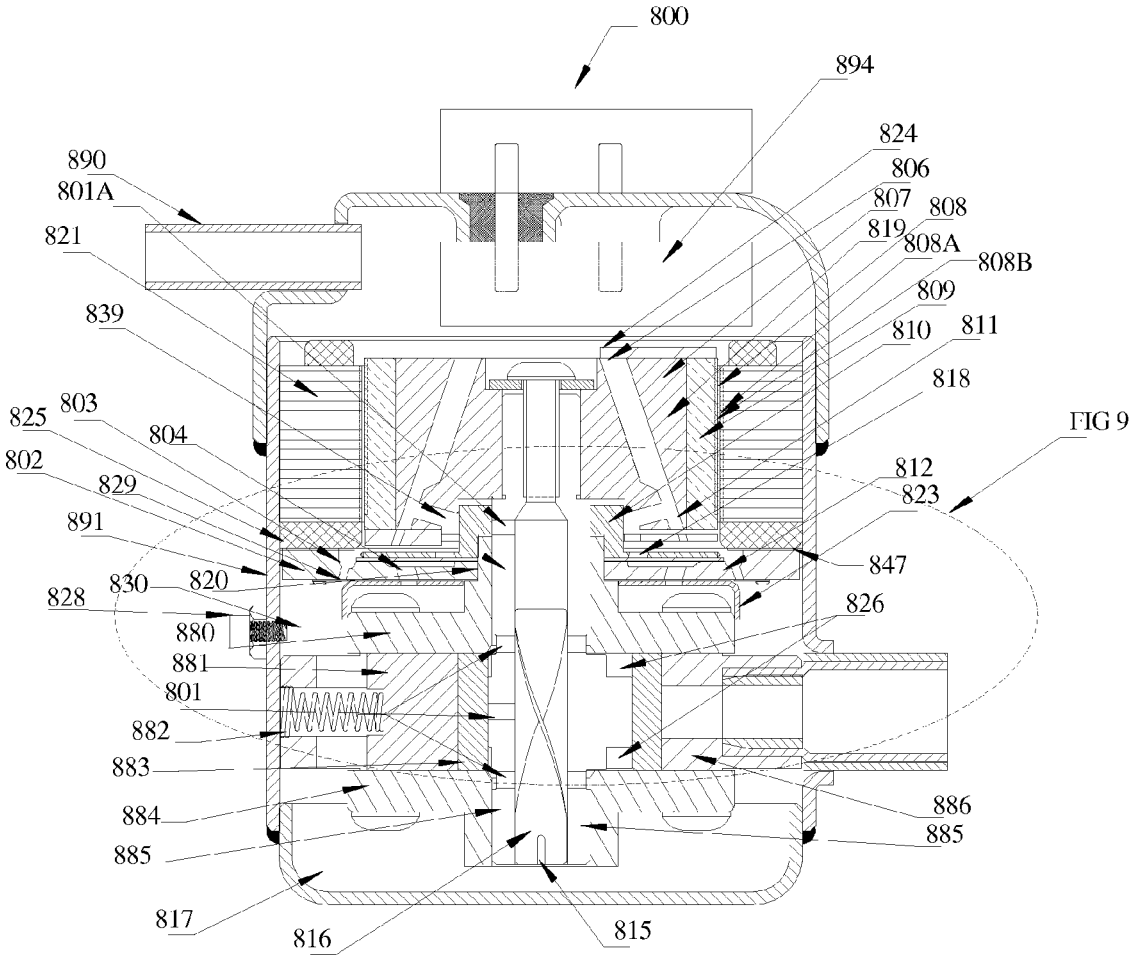
FIG. 8 illustrates a cross-sectional side view of an integral, orientation-insensitive oil management system comprised in a hermetically sealed miniature rolling piston compressor, -according to an embodiment of the present invention.
Figure 9:
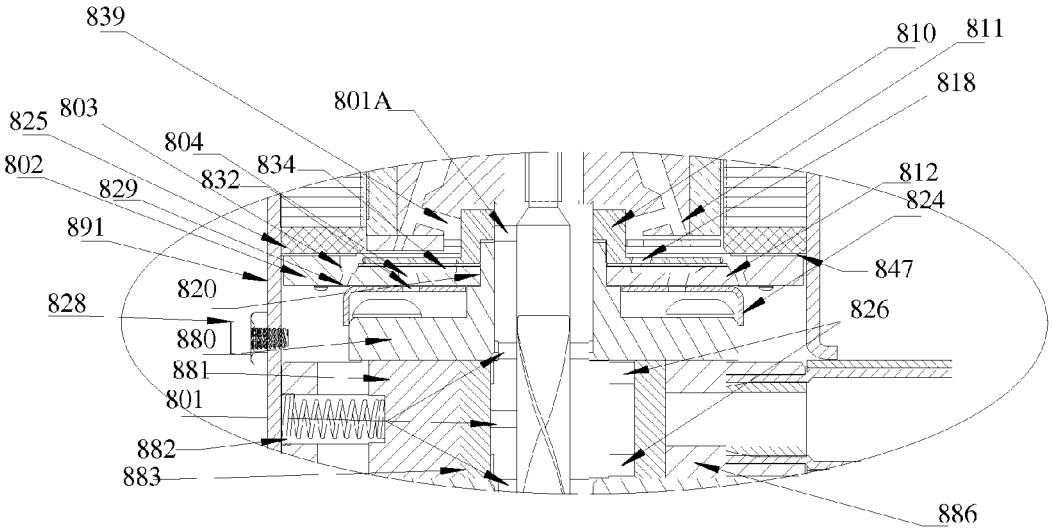
FIG. 9 illustrates an expanded view of an embodiment of the oil management system illustrated in FIG. 8 (shown via dashed lines forming an ellipse), illustrating details of the oil separator, disk shaped centrifugal oil pump, flow paths for the refrigerant and oil, and other design features of the oil pump to minimize frictional losses of the pump.

In another embodiment of the present invention, as shown in FIG. 8 and FIG. 9, a hermetic rolling piston compressor assembly 800 comprises a pump assembly, a brushless DC motor (comprising rotor 819 and stator 821, rotor 819 comprising iron core 807 and magnet 809), an oil management system of the current embodiment of the present invention, a terminal block 894, and a casing 891. The pump assembly comprises compressor cylinder 886, a shaft (also referred to as a crankshaft) 885 having an eccentric part, an upper bearing (also referred to as top flange) 880 and a lower bearing (also referred to as bottom flange) 884 supporting shaft 885, a roller 883, a vane 881, and a vane spring 882. Shaft 885 comprises three lubricating ports 801 a vapor vent port 801A, and a bottom oil pickup 815 at the bottom tip of shaft 885. Shaft 885 comprises an unidirectional fluted oil pump 816, which is identical to the design shown in FIG. 1. Shaft 885 and roller 883, together with bottom flange 884 and top flange 880, form internal oil reservoirs 826 to promote uninterrupted lubrication of the pump mechanisms in the event that the oil level in the sump 817 becomes low or the oil pickup 815 is not in contact with the oil in the sump 817 due to momentary tilting of the compressor itself. The space within the hermetic casing is separated into two sections, with respect to oil, by the oil dam 802. The space below oil dam 802, bounded by the casing and the pump parts, comprises the oil reservoir space 830, which includes the traditional oil sump 817. The space inside the casing above the oil dam 802, which is referred to as the oil separation space, comprises three oil separators rotor cavity oil separator 806 (refrigerant outlet) and 811 (oil outlet and mixture inlet), 2) air gap oil separator 808A on stator 821 and/or air gap oil separator 808B on rotor 819, and 3) rotating disk oil separator pump 810. The rotor cavity oil separator 806 of this embodiment is an articulated cavity version. The oil dam 802 comprises one oil collection manifold 803. Oil collection manifold 803 receives the oil pumped by the rotating disk oil pump 810. Oil collection manifold 803 connects to the oil reservoir space 830 via a check valve 829. Below the oil dam 802, the oil reservoir space is pressurized slightly above the discharge pressure, and the conventional oil lubrication systems described in FIG. 1 takes over to provide lubrication to compressor parts. The key difference between this embodiment and the conventional sump system of FIG. 1 is that the oil reservoir space 830 is almost always full and pressurized so that there is no lack of lubrication in any orientation under any gravitational field.

In the prior art, as shown in FIG. 1, a compressor assembly contains a rotor 119 comprising a permanent magnet 109 and a ring shaped iron core 107 that holds and supports the permanent magnet 109. The rotor core provides the paths for the magnetic flux lines for the magnets. In a typical prior art motor, the iron ring is fabricated from a solid ring, as shown in FIG. 1. In one embodiment of the present invention, as shown in FIG. 8 and FIG. 9, the core 807 of rotor 819 comprises three sets of holes forming tilted tubular passages 806, 811 and 839 ("806-811-839"; 806 for the rotor separator refrigerant discharge, 811 for the rotor separator oil discharge, and 839 for the rotor separator refrigerant oil mixture intake) drilled therein and disposed in such a way that the iron ring comprising tilted tubular passages 806-811-839 still provide sufficient magnetic flux paths and structural support. The tilted tubular passages 806-811-839 may be tilted both in the direction of the rotation and radially decreasing, as viewed from the bottom of the rotor toward the top of the rotor at an angle with respect to the vertical axis. The tilted tubular passages 806-811-839 contain the mixture of refrigerant vapor and oil, and when the rotor rotates, the tilted holes also rotate, thus creating essentially a centrifugal oil separator within the rotor. In such a configuration, the tilted holes 806-811-839 function as oil separators by collecting the oil droplets that have density higher than the carrier fluid (in this case refrigerant vapor) and being slung onto the surfaces of the tubular passages 806-811-839 away from the axis of rotation. Then, the centrifugal force generated by the rotation of the tubular passage will push the liquid film down the tubular passages in the direction opposite from the refrigerant vapor flow. The diameter of these holes and the number of the holes are configured so as to allow the flow velocity to be lower than the entrainment limit in the tilted tubes. In other words, the flow velocity of the refrigerant vapor flowing in the tilted tube toward the rotor separator oil discharge 811 is low enough not to re-entrain the separated oil that is being pushed back in the other direction down the tilted tube wall toward the rotating oil pump. In this embodiment, there are three potential paths for the compressed refrigerant vapor to travel past the brushless DC motor section to reach the discharge tube. These paths are:

1. A set of relatively large diameter, rotor separator refrigerant intake holes 839 in the rotor iron circumferentially located near the inner edge of the rotor iron. Of the three paths, this path has the largest flow area and the lowest flow resistance for the oil vapor laden-refrigerant vapor.
2. A set of relatively smaller diameter holes, rotor separator oil discharge holes 811 in the rotor iron circumferentially located near the outer edge of the rotor iron. This path has much smaller flow area than that of the rotor separator refrigerant intake holes 839 and much higher flow resistance for the oil containing refrigerant vapor.
3. The relatively small radial air gap 808 between the stator lamination stack and the rotor magnet 809.

Due to the fact that the rotor separator refrigerant intake holes 839 collectively have by far the largest flow area and lowest flow resistance, this set of holes constitute the primary path for the oil-containing compressed refrigerant vapor through which vast majority (e.g., 90%) of the oil-carrying compressed refrigerant vapor will pass through. The second set of smaller holes, rotor separator oil discharge holes 811, are designed to collect and return the separated oil from the refrigerant vapor and relatively minor portion (e.g., 6%) of the refrigerant vapor will pass through these holes. The stator/rotor air gap 808 represents an even smaller fraction (e.g., 4%) of the overall flow path for the refrigerant; and even in this case, most of the entrained oil will be separated from the refrigerant flow through the air gap 808 by the tilted groove shaped oil separators 808A on the stator stack, formed by the stator laminated stack on the inner diametral surface of the stator 821, or oil separators 808B on the outer diametral surface of the rotor 819.

In this embodiment, the tilted tubular passages 806-811-839 form bifurcated tubular passages, and they are fabricated by drilling the rotor iron from three general drill locations for each set: the holes 806 are drilled using the largest drill bit from the top surface of the rotor iron near the inner diameter, the holes 811 are drilled from the bottom near the outer edge, and the smallest holes 839, for liquid return, are drilled from the bottom near the inner diameter.

Referring to FIG. 8 and FIG. 9, the oil laden compressed refrigerant vapor comes out from the top flange 880, and travels through the following paths: a set of holes 832 in the muffler 824, then the refrigerant discharge holes 804 in the oil dam 802, refrigerant discharge manifold 834, refrigerant discharge holes 818 in the rotating disk centrifugal oil pump 810, submotor refrigerant manifold 845, rotor separator refrigerant intake holes 839, rotor separator refrigerant discharge passages 806, space below the top cap of casing 891, and finally the discharge tube 890. The oil laden compressed refrigerant vapor, as it enters the nearly horizontal radial holes 839, will experience a strong centrifugal force due to the rotational motion of the rotor and, as oil has much higher density than the refrigerant, will tend to collect on the outer or peripheral side of the tubular passages 811-806. Because tubular passages 811-806 are tilted radially, increasing from the discharge side at the top to the intake side near the bottom of the rotor core 807, any liquid being separated from the refrigerant due to centrifugal force and pushed to the surfaces of the holes will be pushed downward toward the oil discharge holes 811. The angle between the radial holes 839 and the axis of rotation, as shown in FIG. 8 and FIG. 9, is approximately 70 degrees but it can range between 0 and 90 degrees, depending on the rotational speed and density difference between the refrigerant and the oil as well as the physical geometry of the rotor. The angle between the holes 839 and 806, as shown in FIG. 8 and FIG. 9, is 90 degrees but it can be between 0 and 100 degrees. The latter case of 0 degrees between the holes implies that the three sets of holes 806, 811 and 839 are all merged into one set of holes, e.g., holes 806 extending from the top to the bottom, and holes 811 and 839 disappear, as shown in FIG. 4, FIG. 5*a*, FIG. 6 and FIG. 7. In this case, the single set of holes act as intake, oil return and refrigerant discharge all at once, as described above. Also, optional separator vanes can be attached at the bottom of the rotor to promote oil separation; however, the increased aerodynamic friction will have to be taken into consideration to prevent any unacceptable increase in power consumption by the compressor.

Immediately below the oil return holes 811 of the oil separator embedded in the iron core 807 of rotor 819, there is a rotating disk centrifugal pump 810 connected to the rotating shaft 85. The rotating disk centrifugal pump 810 comprises a set of holes 818 (e.g., six, as before) located circumferentially near the rotating shaft to allow the compressed refrigerant vapor from the compressor pump section to readily pass through toward the oil separator in the rotor with minimal flow resistance. These holes 818 can be perpendicular to the rotating plane of the disk 810 or they can be tilted circumferentially either in the direction of rotation or against the direction of rotation in consideration of lowering flow resistance or increasing oil droplet capture efficiency. The holes 818 can be also tilted radially to promote oil separation. The centrifuged liquid drops are pushed toward the bottom and ejected from the nozzles of the oil separators, and the liquid dropped on the rotating disk centrifugal pump 810 is pushed outward in an expanding spiral, and eventually pushed in the outward radial direction by rotating disk centrifugal pump 810 below the nozzles at the bottom end of oil return holes 811. As shown in FIG. 8 and FIG. 9, the rotating disk centrifugal pump 810 extends up to just under the bottom of the stator 821 or it could be extended into the oil collection manifold 803. The radial overlap distance can be between zero (as shown) and a portion of the oil collection manifold 803. On the one hand, if the distance of the disk centrifugal pump 810 immersed in the oil inside the oil collection manifold 803 is excessive, the viscous damping loss due to the high rotational speed of the disk will increase. On the other hand, if the distance is zero, then the only pumping pressure will be mostly generated through the energy conversion from dynamic (both circumferential and radial motion of the fast rotating oil layer on the disk) to static head pressure of the oil being pumped within the groove, which may or may not be sufficient to maintain the oil pressure in the oil collection manifold 803. The bottom of the stator 821 is covered by a thin and circular bottom plate 847 to guide the oil being pushed into the gap between the rotating disk 810 and the bottom of the stator 821, and eventually into oil collection manifold 803. The rotation of the disk 810 generates a flow of collected oil into the gap spiraling away from the tip of the disk 810. The oil being pushed into the gap flows into a circular oil collection manifold 803 that serves to feed the pressurized oil into the compressor pump parts through oil supply paths 812 that emanate from the circular oil collection manifold 803 and extending to the oil supply groove 820 and supply holes 839 near the spin axis. The dynamic pressure of the liquid flowing into the groove rotating at high speed turns into a static pressure in the oil collection manifold 803 that is used to pump the oil into the supply holes 839. In other words, this oil pump is self-priming. When the oil is introduced into the internal parts of the compressor for lubrication purpose, the oil is mixed into the refrigerant. When the compressor discharges the oil/refrigerant vapor, the oil separators in the iron core 807 of rotor 819 and the rotor/stator air gap 808 separate the oil, and the rotating disk centrifugal oil pump 810 sends the oil back to the compressor pump section. This is a pressurized loop oil management system embedded inside the miniature rolling piston compressor, and keeps most of the oil within the compressor; very little oil travels out of the compressor and into the heat exchangers and other components of the refrigeration system, and thereby increasing the efficiency and even capacity of the refrigeration system.

In all of the above embodiments, as shown in FIG. 4 through FIG. 9, one characteristic is shared by all the separator holes in the rotor: the holes in the rotor iron are tilted, as described above, to create the centrifugal separation oil from the refrigerant. In the embodiment shown here (using FIG. 8), with three sets of holes, as the oil laden refrigerant exits from holes 839 and enters holes 806 the refrigerant-oil mixture undergoes a slight drop in velocity as it enters the much larger diameter holes 806 thereby increasing the relative effect of centrifugal force compared to the entrainment force of the carrier vapor and thus facilitating the separation of oil from the refrigerant vapor.

The following description is provided to illustrate the overall paths and management scheme for the lubricating oil in the compressor of one embodiment of the present invention:

1. The oil reservoir space 830—the primary oil reservoir in the lower portion of the compressor assembly below the oil dam. The oil reservoir space is maintained almost always full and kept at the discharge pressure during operation.
2. The oil separation space—the upper half of the compressor assembly, which is also at discharge pressure, is separated from the oil reservoir space in the lower half by the oil dam 802. The upper half of the compressor is largely devoid of oil, except what remains in the discharge refrigerant flow after the series of oil separation stages.
3. Lubricating oil from the oil reservoir space enters the compression chamber through:
   a. Vane slot as part of the effort to lubricate the vane from the traditional oil sump. Because the pressure inside the compression chamber is lower than the oil reservoir pressure, the oil tends to seep into the compression chamber.
   b. Three oil supply holes 801 (also referred to as three lubricating ports 801) in shaft 885 are fed by the unidirectional screw pump 816 pumping oil from the traditional oil sump 817. These holes provide lubrication for interface between shaft 885 and roller 883, as well as internal oil reservoirs 826 that help lubricate the contact area between shaft 885 and roller 883, as well as the contact area between roller 883 and the top flange 880 and the bottom flange 884
   c. Lubricating oil also enters the compressor from the slot for vane 881.
4. Once the lubrication oil is inside the pump mechanism, it travels into the compression chamber into which intake refrigerant enters and is mixed with the oil that has infiltrated. During the discharge process, the oil contained in the refrigerant vapor is separated and pumped back in to the oil reservoir space 830 from the oil collection manifold 803 via a check valve 829.

The arrangement of flow paths described above facilitates the filtering or separating of the oil from the refrigerant stream traveling out of the compressor, and thereby reducing the oil circulation in the rest of the refrigeration system. Lower oil content in the refrigerant in the refrigeration system outside of the compressor has many advantages, such as higher effectiveness of heat exchangers, lower pressure drop in various flow paths, lower power consumption, higher capacity, higher efficiency, and a more stable oil level in a smaller oil sump, which can translate into smaller compressor assembly and higher specific capacity.

The oil dam of the present invention can be fabricated from any metal, plastic, or composite material, or any combination thereof. The oil separator and pump can be fabricated from any metal or plastic, or a combination thereof. Other components of the present invention are standard parts that should be readily available.

As noted above, the present invention pertains to a pressurized loop oil management system incorporated within a casing or housing of fluid displacement machinery that enables operation of the machinery in all orientations without regard to the level of gravity. The present invention should not be considered limited to the particular embodiments described above, but rather should be understood to cover all aspects of the invention as fairly set out in the appended claims. Various modifications, equivalent processes, as well as numerous structures to which the present invention may be applicable will be readily apparent to those skilled in the art to which the present invention is directed upon review of the present specification. The claims are intended to cover such modifications.

We claim:

1. An orientation and gravity insensitive oil management system integrated into the casing of a fluid displacement device, comprising:

a) an oil dam housed in a casing of a fluid displacement device, said oil dam defining: i) an oil reservoir space between the casing of a fluid displacement device and one side of the oil dam, said oil reservoir space comprising a compressor pump part, and ii) an oil separation space between the casing and the other side of the oil dam;

b) at least one oil separator and at least one oil pump forming at least one integrated unit, said at least one integrated oil separator/oil pump unit being capable of creating a pressure differential in the oil and pumping the oil from the oil separation space to the oil reservoir space, and being configured for operation with a drive mechanism of the fluid displacement device and being located in the oil separation space;

c) at least one oil collection manifold being located in the oil separation space;

d) one or more separated oil return paths being located in the oil dam; and e) one or more oil lubrication paths of the fluid displacement device being located in the oil reservoir space, said components a)-e) being in communication and forming a pressurized loop, and said oil management system in entirety being incorporated inside the casing of the fluid displacement device without affecting the size of said casing.

2. The orientation and gravity insensitive oil management system according to claim 1, said integrated oil separator/oil pump unit comprising a core portion and an outer portion, said outer portion resembling a rotating disk and capable of functioning as an oil pump.

3. The orientation and gravity insensitive oil management system according to claim 2, said rotating disk comprising a set of holes configured for allowing the flow of separated working fluid to pass through toward a discharge port of the fluid displacement device.

4. The orientation and gravity insensitive oil management system according to claim 2, said core portion comprising internal fluid passages forming the oil separator, and said rotating resembling a flat disk.

5. The orientation and gravity insensitive oil management system according to claim 4, said at least one integrated oil separator/oil pump unit being centrifugal in nature and located between the oil dam and the drive mechanism of the fluid displacement device.

6. The orientation and gravity insensitive oil management system according to claim 4, said outer portion of the at least one integrated oil separator/oil pump unit comprising protruding fins or ridges on the surface of the flat disk.

7. The orientation and gravity insensitive oil management system according to claim 5, said centrifugal oil separator portion of the at least one integrated oil separator/oil pump unit being embedded within a rotor of the drive mechanism.

8. The orientation and gravity insensitive oil management system according to claim 7, said centrifugal oil separator portion of the at least one integrated oil separator/oil pump unit comprising at least two radially tilted, bifurcated flow path holes in the rotor, each said hole comprising three ports and three flow paths.

9. The orientation and gravity insensitive oil management system according to claim 8, said flow path holes being capable of facilitating oil flow in the direction opposite to the working fluid and preventing re-entrainment of the separated oil.

10. The orientation and gravity insensitive oil management system according to claim 8, said flow path holes being circumferentially tilted.

11. The orientation and gravity insensitive oil management system according to claim 7, said centrifugal oil separator portion of the at least one integrated oil separator/oil pump unit comprising at least two radially tilted, straight-through flow path holes in the rotor, the center axis of said holes start near the periphery of the rotor at the bottom of the rotor and move radially inward the toward the top of the rotor.

12. The orientation and gravity insensitive oil management system according to claim 11, said at least two radially tilted, straight-through flow path holes and radial tilting of the holes being configured for facilitating oil flow in the direction opposite to the working fluid and for preventing entrainment of the separated oil.

13. The orientation and gravity insensitive oil management system according to claim 11, said at least two radially tilted, straight-through flow path holes being circumferentially tilted.

14. The orientation and gravity insensitive oil management system according to claim 1, said oil dam comprising an integrated check valve capable of allowing the unidirectional flow of pumped oil back into the oil reservoir space but preventing back flow from the oil reservoir space into the oil separation space.

15. The orientation and gravity insensitive oil management system according to claim 1, comprising a flute pump in the oil reservoir space, said flute pump being a double-acting screw pump configured for being embedded inside of a rotating shaft comprising holes, said flute pump comprising two opposing screws arranged back to back and capable of pumping oil from either one end of the shaft alone or both ends of the shaft simultaneously and supplying lubricating oil to the fluid displacement device via the holes in the rotating shaft.

16. The orientation and gravity insensitive oil management system according to claim 1, comprising a flute pump in the oil reservoir space, said flute pump being a single-acting screw pump configured for being embedded inside of a rotating shaft comprising holes, said flute pump comprising one screw capable of pumping oil from the tip of the rotating shaft to supply lubricating oil to the fluid displacement device via the holes in the rotating shaft.

17. The orientation and gravity insensitive oil management system according to claim 1, said fluid displacement device being an oil lubricated compressor, expander, engine or pump of reciprocating or rotary type.

18. The orientation and gravity insensitive oil management system according to claim 17, said fluid displacement device being a refrigeration compressor suitable for portable applications comprising personal cooling systems, portable blood coolers, portable refrigerated transport cases, beverage coolers, and mobile cooling systems on-board of vehicles, aircraft, and spacecraft.

19. A method of operating the orientation and gravity insensitive oil management system of claim 1, comprising the steps of:

a) incorporating the oil management system of claim 1 into a fluid displacement device comprising a working fluid;

b) filling the oil reservoir space with oil;

c) separating oil from the outgoing working fluid;

d) pressurizing the oil in the reservoir space via the oil pump portion of the at least one integrated oil separator/oil pump unit; and sending substantially most of the separated oil, originally contained in the working fluid, back into the oil reservoir space.

20. The method according to claim 19, comprising driving said at least one integrated oil separator/oil pump unit via a drive mechanism of the fluid displacement device.

21. The method according to claim 19, comprising promoting the flow of oil through at least two radially tilted, bifurcated flow path holes of the oil separator portion of said at least one integrated oil separator/oil pump unit embedded within a rotor of the drive mechanism, in the direction opposite to the working fluid, and preventing re-entrainment of the separated oil.

22. The method according to claim 19, comprising promoting the flow of oil through at least two radially tilted, straight-through flow path holes of the oil separator portion of said at least one integrated oil separator/oil pump unit embedded within a rotor of the drive mechanism, in the direction opposite to the working fluid while preventing entrainment of the separated oil.

23. The orientation and gravity insensitive oil management system according to claim 1, said fluid displacement device being capable of operation in any orientation, or under zero gravity, or near-zero gravity.

24. The method according to claim 19, said fluid displacement device being operated in any orientation and/or under any level of gravity.

* * * * *